US011492993B2

(12) United States Patent
Oda et al.

(10) Patent No.: US 11,492,993 B2
(45) Date of Patent: Nov. 8, 2022

(54) ENGINE SYSTEM

(71) Applicant: Mazda Motor Corporation, Hiroshima (JP)

(72) Inventors: Yusuke Oda, Aki-gun (JP); Naoki Mine, Aki-gun (JP); Tomomi Watanabe, Aki-gun (JP); Atsushi Suzuki, Aki-gun (JP); Junsou Sasaki, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/684,925

(22) Filed: Mar. 2, 2022

(65) Prior Publication Data

US 2022/0307442 A1 Sep. 29, 2022

(30) Foreign Application Priority Data

Mar. 26, 2021 (JP) ..... JP2021-053082

(51) Int. Cl.
*F02D 41/00* (2006.01)
*F02M 26/00* (2016.01)
(Continued)

(52) U.S. Cl.
CPC ..... *F02D 41/3041* (2013.01); *F02D 41/401* (2013.01); *F02D 2041/0015* (2013.01);
(Continued)

(58) Field of Classification Search
CPC ..... F02D 41/3023; F02D 41/3029; F02D 41/3035; F02D 41/3041; F02D 41/3047;
(Continued)

(56) References Cited

U.S. PATENT DOCUMENTS 10,697,391 B2 6/2020 Inoue et al.
2002/0026921 A1* 3/2002 Ueno ..... F02D 41/1497 123/295
(Continued)

FOREIGN PATENT DOCUMENTS

JP 2002130025 A 5/2002
JP 2018193987 A 12/2018
(Continued)

OTHER PUBLICATIONS

European Patent Office, Extended European Search Report Issued in Application No. 22154872.0, dated Jul. 20, 2022, Germany, 8 pages.

*Primary Examiner* — Erick R Solis
(74) *Attorney, Agent, or Firm* — Alleman Hall Creasman & Tuttle LLP

(57) ABSTRACT

An engine system is provided, which includes an engine, a swirl control valve, an EGR passage, an EGR gas adjusting mechanism, and a controller. The engine includes a cylinder, a piston, and a fuel injection valve. The swirl control valve is provided inside an intake passage and generates a swirl flow inside the cylinder when it closes. When an engine load is at or below a given threshold, the controller controls the swirl control valve to close. While the engine load is the threshold or below, the controller controls the EGR gas adjusting mechanism such that, at a fixed engine speed, an increase rate of an EGR gas amount with respect to an increase in the engine load is lower in a first load range than in a second load range, the first load range being on a higher load side of the second load range and including the threshold.

19 Claims, 5 Drawing Sheets

(51) Int. Cl.
*F02D 41/30* (2006.01)
*F02D 41/40* (2006.01)

(52) U.S. Cl.
CPC . *F02D 2200/101* (2013.01); *F02M 2026/003* (2016.02); *F02M 2026/009* (2016.02)

(58) Field of Classification Search
CPC ..... F02D 41/3052; F02D 2041/0015; F02M 2026/003; F02M 2026/009
USPC ..... 123/295, 308, 430, 432, 568.21
See application file for complete search history.

(56) References Cited

U.S. PATENT DOCUMENTS

| | | | | |
|---|---|---|---|---|
| 2016/0245128 | A1* | 8/2016 | Shintani | F02D 35/02 |
| 2018/0334998 | A1 | 11/2018 | Inoue et al. | |
| 2019/0360449 | A1 | 11/2019 | Inoue et al. | |
| 2019/0390627 | A1* | 12/2019 | Youso | F02D 41/3035 |
| 2020/0248636 | A1* | 8/2020 | Inoue | F02D 41/3041 |

FOREIGN PATENT DOCUMENTS

| | | | | |
|---|---|---|---|---|
| JP | 6558427 | B2 | | 8/2019 |
| JP | 2020122447 | A | * | 8/2020 |

* cited by examiner

ENGINE SYSTEM

TECHNICAL FIELD

The present disclosure relates to an engine system having a swirl control valve which generates a swirl flow inside a cylinder.

BACKGROUND OF THE DISCLOSURE

Conventionally, technologies are known, in which a swirl control valve (hereinafter, suitably be referred to as an "SCV") is provided to one of two intake ports which supply intake air to each cylinder, and opening of the SCV is set to a close side (typically, fully closed) to generate a swirl flow inside the cylinder. For example, JP2002-130025A discloses a technology to switch opening of such an SCV according to an operation state of an engine. In detail, the SCV is closed in a low load range of the engine, and is opened in a high load range. Particularly, in the low load range, fuel is injected during a compression stroke while a swirl flow is generated so as to achieve an operation with stratified-charge combustion, whereas in the high load range, fuel is injected during an intake stroke while a tumble flow is generated so as to achieve an operation with homogeneous combustion.

Moreover, for example, JP2018-193987A discloses a technology in which an engine is provided with, in addition to an SCV as described above, an EGR (exhaust gas recirculation) system which recirculates exhaust gas of the engine to an intake passage as EGR gas, and an EGR rate which is a rate of an amount of EGR gas contained in intake air (fresh air +EGR gas) supplied to the engine is reduced as an engine load increases.

As described in JP2002-130025A, in many cases, the engine system including the SCV controls the SCV to fully close in the low load range, and controls the SCV to fully open in the high load range. Moreover, from the viewpoint of reducing a pumping loss of the engine, in the low load range, it is desired to control the EGR system to increase the amount of EGR gas to be recirculated to the intake passage.

Here, when the SCV is switched from fully closed to fully opened corresponding to the shift of the operation state of the engine from the low load range to the high load range, a state where only one intake port communicates with each cylinder is shifted to a state where two intake ports communicate with the cylinder. Therefore, while the SCV is switched from fully closed to fully opened, a blown back amount (backflow amount) of exhaust gas from an exhaust passage to the intake passage during a valve overlap period where both of an intake valve and an exhaust valve open increases compared with before the switching, which is likely to increase an amount of exhaust gas (i.e., internal EGR gas) introduced into the cylinder. As a result, when a comparatively large amount of EGR gas (i.e., external EGR gas) is recirculated by the EGR system in the low load range as described above, the total amount of exhaust gas (i.e., the total amount of external EGR gas and internal EGR gas) introduced into the cylinder upon the switching of the SCV from fully closed to fully opened becomes excessive, which degrades combustion stability.

SUMMARY OF THE DISCLOSURE

The present disclosure is made in view of solving the problem described above, and one purpose thereof is to provide an engine system, capable of avoiding lowering of combustion stability due to excessive exhaust gas recirculation (EGR) gas when a swirl control valve set to fully closed in a low load range is switched to fully opened.

According to one aspect of the present disclosure, an engine system is provided, which includes an engine, a swirl control valve, an EGR passage, an EGR gas adjusting mechanism, and a controller. The engine includes a cylinder defining a combustion chamber, a piston configured to reciprocate inside the cylinder, and a fuel injection valve configured to directly inject fuel into the cylinder. The swirl control valve is provided inside an intake passage and generates a swirl flow inside the cylinder when the swirl control valve closes, the intake passage being configured to supply intake air to the cylinder. The EGR passage recirculates exhaust gas of the engine as EGR gas to the intake passage. The EGR gas adjusting mechanism is provided to the EGR passage and controls an amount of EGR gas to be recirculated to the intake passage. The controller controls the fuel injection valve, the swirl control valve, and the EGR gas adjusting mechanism. When an engine load is at or below a given threshold, the controller controls the swirl control valve to close. While the engine load is at or below the threshold, the controller controls the EGR gas adjusting mechanism such that, at a fixed engine speed, an increase rate of the amount of EGR gas with respect to an increase in the engine load is lower in a first load range than in a second load range, the first load range higher than the second load range and including the threshold.

According to this configuration, in the low load range where the engine load is at or below the threshold, when the engine load is separated from the threshold (in the second load range), the controller controls to increase the amount of EGR gas as the engine load increases, whereas, when the engine load is near the threshold (in the first load range), the controller controls to avoid the increase in the amount of EGR gas corresponding to the increase in the engine load. Thus, even when an amount of internal EGR gas increases as described above during the switching of the swirl control valve (SCV) from fully closed to fully opened corresponding to shift of an operation state of the engine from the low load range to a high load range, the increase in an amount of external EGR gas corresponding to the engine load increase can accurately be suppressed. As a result, upon the switching of the SCV from fully closed to fully opened, the increase in the total amount of exhaust gas (i.e., the total amount of external EGR gas and internal EGR gas) introduced into the cylinder can be avoided, and combustion stability can be secured.

In the second load range, the controller may control the EGR gas adjusting mechanism to increase the amount of EGR gas as the engine load increases. On the other hand, in the first load range, the controller may control the EGR gas adjusting mechanism to keep the amount of EGR gas substantially constant regardless of the increase in the engine load.

According to this configuration, in the first load range, the controller adjusts the amount of EGR gas to be substantially constant regardless of the increase in the engine load. Thus, the amount of external EGR gas introduced into the cylinder when the SCV is switched from fully closed to fully opened can effectively be reduced, and combustion stability can certainly be secured.

When the engine load exceeds the threshold, the controller may control the swirl control valve to open, and control the EGR gas adjusting mechanism to reduce the amount of EGR gas as the engine load increases.

According to this configuration, in the high load range, since the controller reduces the amount of EGR gas as the engine load increases, an amount of fresh air introduced into the cylinder is increased and the engine output can be improved.

When the engine load is at or below the threshold, the controller may control the fuel injection valve to inject fuel all at once during an intake stroke of the engine. On the other hand, when the engine load exceeds the threshold, the controller may control the fuel injection valve to inject fuel a plurality of times from an intake stroke to a compression stroke of the engine.

According to this configuration, in the low load range, the controller executes the batch injection of fuel during an intake stroke, thereby homogeneous combustion appropriately being achieved in the engine. Moreover, in the high load range, the controller executes the split injection of fuel from an intake stroke to a compression stroke, thereby stratified-charge combustion appropriately being achieved in the engine.

The fuel injection valve may be provided inclininglyy with respect to an axial direction of the piston.

Furthermore, a crown surface of the piston may be formed to be substantially flat without a cavity.

The EGR gas adjusting mechanism may be an EGR valve.

DETAILED DESCRIPTION OF THE DISCLOSURE

Hereinafter, an engine system according to one embodiment of the present disclosure is described with reference to the accompanying drawings.

Configuration of Engine System

Figure 1:
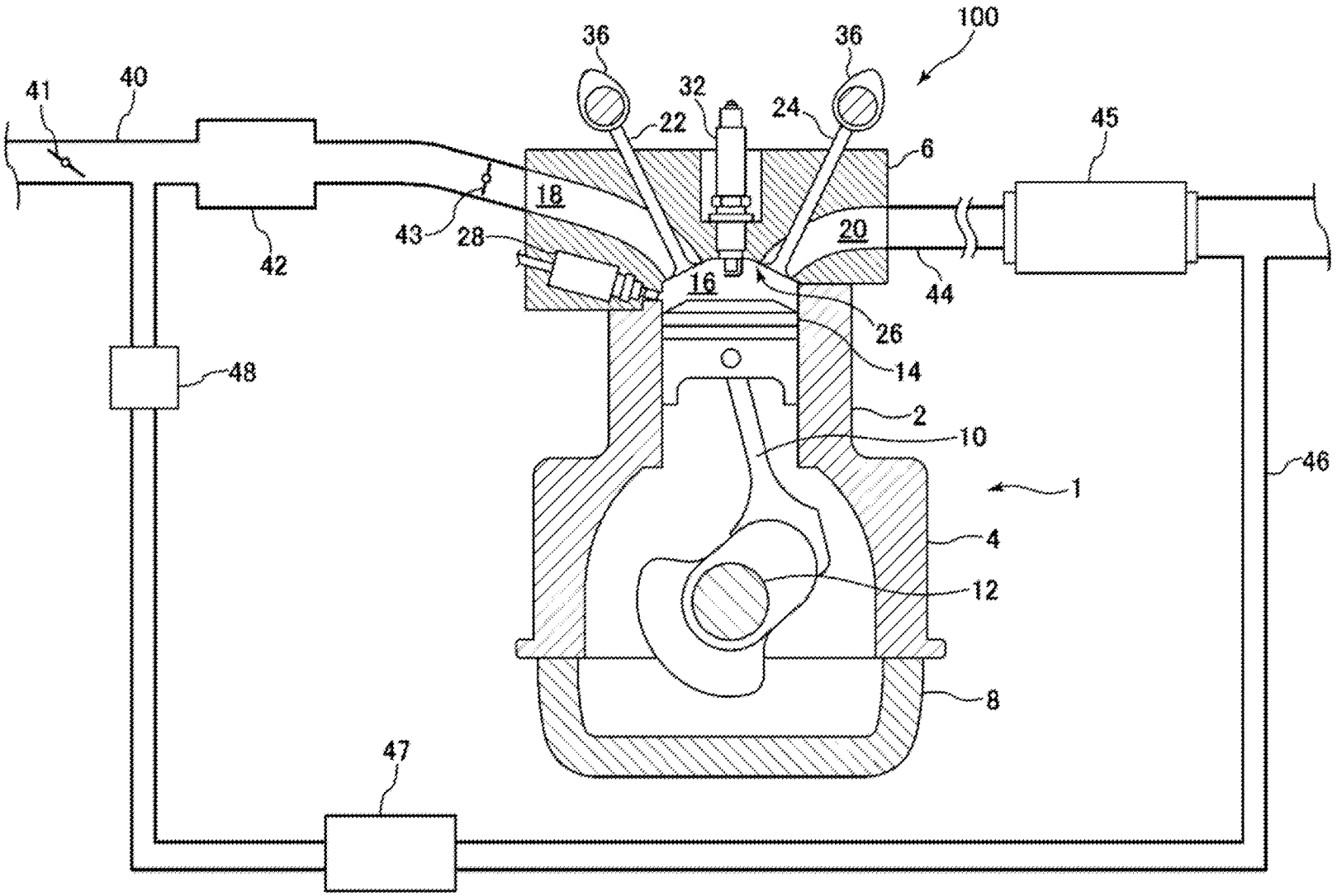
FIG. 1 is a diagram schematically illustrating a configuration of an engine system according to one embodiment of the present disclosure.

FIG. 1 is a diagram schematically illustrating a configuration of the engine system according to this embodiment. As illustrated in FIG. 1, an engine system 100 includes an engine 1 mounted on a vehicle. The engine 1 is a gasoline engine to which fuel at least containing gasoline is supplied. In detail, the engine 1 includes a cylinder block 4 provided with cylinders 2 (note that, although one cylinder 2 is illustrated in FIG. 1, for example, four cylinders 2 may be aligned in a row), a cylinder head 6 provided above the cylinder block 4, and an oil pan 8 provided below the cylinder block 4 and storing lubricant therein. A piston 14 which is coupled to a crankshaft 12 via a connecting rod 10 is reciprocatably inserted into each cylinder 2. The cylinder head 6, the cylinder 2, and the piston 14 define a combustion chamber 16 of the engine 1.

Intake air is supplied to the engine 1 from an intake passage 40. The intake passage 40 is provided thereon with a throttle valve 41 which is adjustable of an amount of intake air to be supplied to the engine 1, and a surge tank 42 which temporality stores intake air to be supplied to the engine 1. Further, part of the intake passage 40 constitutes an intake port 18 connected to the engine 1.

Two independent intake ports 18 and two independent exhaust ports 20 are connected to the engine 1 for each cylinder 2, and the intake ports 18 and the exhaust ports 20 are provided with intake valves 22 and exhaust valves 24 which open and close openings on the combustion chamber 16 side, respectively. Here, in response to opening of the intake valve 22 and descending of the piston 14, a tumble flow (vertical (longitudinal) vortex) is generated by intake air flowed into the combustion chamber 16 from the intake port 18.

Further, one of the two intake ports 18 for each cylinder 2 is provided with a swirl control valve (SCV) 43 which opens and closes a flow passage of the intake port 18. Note that, in FIG. 1, only one intake port 18 to which the SCV 43 is provided is illustrated, and the other intake port 18 without the SCV 43 is not illustrated. When the SCV 43 is closed, intake air is flowed into the combustion chamber 16 only from one of the two intake ports 18, and therefore, a swirl flow (horizontal (transverse) vortex) is generated inside the combustion chamber 16.

A lower surface of the cylinder head 6 of the engine 1 forms a ceiling 26 of the combustion chamber 16. This ceiling 26 is a so-called pentroof type in which two opposing sloped surfaces are provided so as to extend from a central part of the ceiling 26 to a lower end of the cylinder head 6. Further, the cylinder head 6 is attached, for each cylinder 2, with a (direct injection) injector (fuel injection valve) 28 which directly injects fuel into the cylinder 2. The injector 28 is provided inclininglyy with respect to an axial direction of the piston 14 (i.e., a moving direction of the piston 14). In detail, the injector 28 is disposed such that its nozzle is oriented obliquely downwardly into the combustion chamber 16 from between the two intake ports 18 at a periphery of the ceiling 26 of the combustion chamber 16.

Further, a spark plug 32 which forcibly ignites a mixture gas inside the combustion chamber 16 is attached to the cylinder head 6 of the engine 1 for each cylinder 2. The spark plug 32 is disposed to extend downwardly from the central part of the ceiling 26 of the combustion chamber 16 while penetrating the cylinder head 6. Moreover, the cylinder head 6 is provided with valve mechanisms 36 which drive the intake valves 22 and the exhaust valves 24 of each cylinder 2, respectively. The valve mechanism 36 is, for example, a variable valve lift mechanism which can change a lift amount of each of the intake valve 22 and the exhaust valve 24, or a variable valve phase mechanism which can change a rotational phase of a camshaft with respect to the crankshaft 12.

The intake passage 40 is connected to one side surface of the engine 1 as described above, whereas, on the other side surface, an exhaust passage 44 which discharges burnt gas (exhaust gas) from the combustion chamber 16 of each cylinder 2 is connected. The exhaust passage 44 is provided thereon with a catalyst 45 (in detail, a catalytic converter) which purifies exhaust gas. Moreover, the exhaust passage 44 is connected, on a downstream side of the catalyst 45, to an exhaust gas recirculation (EGR) passage 46 which recirculates the exhaust gas to the intake passage 40. The EGR passage 46 is provided thereon with an EGR cooler 47 which cools exhaust gas (EGR gas) to be recirculated, and an EGR valve 48 (EGR gas adjusting mechanism) which adjusts an amount of EGR gas to be recirculated to the intake passage 40. The EGR passage 46, the EGR cooler 47, and the EGR valve 48 constitute an EGR system.

Figure 2:
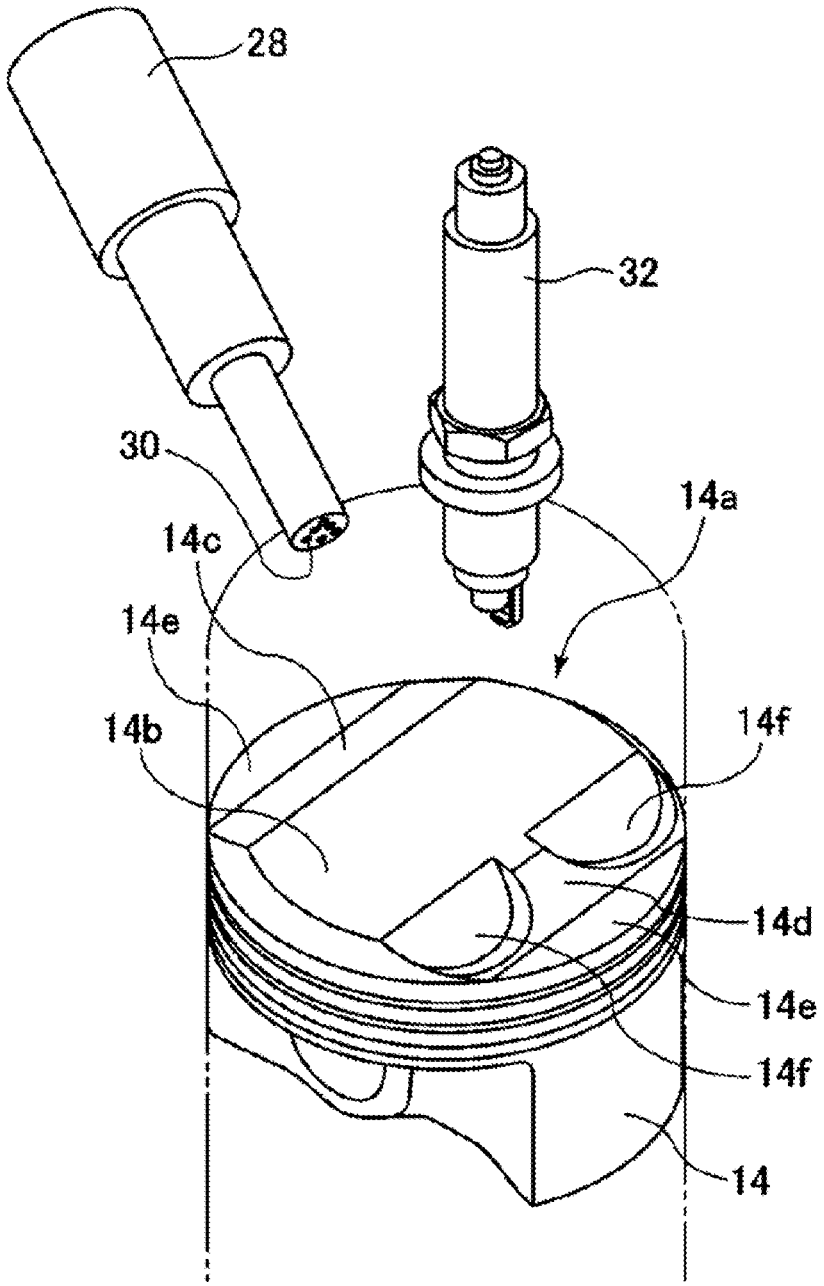
FIG. 2 is a perspective view of an engine according to this embodiment.

Next, FIG. 2 is a perspective view illustrating a detailed structure of the piston 14, the injector 28, and the spark plug 32 of the engine 1 according to this embodiment. As illustrated in FIG. 2, the injector 28 is a multi-nozzle type having a plurality of nozzles 30. The injector 28 is disposed such that an axial direction of the injector 28 inclines downwardly at a given angle with respect to a horizontal direction. Therefore, fuel spray injected from each nozzle 30 of the injector 28 spreads radially to obliquely downward from the periphery of the ceiling 26 of the combustion chamber 16.

Further, a piston crown surface 14*a* which constitutes a top part of the piston 14 is formed as a convex which bulges at its central area. For example, at the center of the piston crown surface 14*a*, a flat surface 14*b* extending along a horizontal surface orthogonal to the axial direction of the piston 14 is formed over a comparatively wide range. The piston crown surface 14*a* is not formed with a so-called cavity.

Further, the piston crown surface 14*a* is provided with an injector side sloped surface 14*c* extending obliquely upward toward the center from an end part of the piston crown surface 14*a* on the injector 28 side, and a counter-injector side sloped surface 14*d* extending obliquely upward toward the center from an opposite end part of the piston crown surface 14*a*. i.e., on the farther side from the injector 28 (hereinafter, may be referred to as a "counter-injector side" as necessary). The injector side sloped surface 14*c* and the counter-injector side sloped surface 14*d* are formed along the ceiling 26 of the combustion chamber 16 (see FIG. 1).

Further, in each end part of the piston crown surface 14*a* on the injector side and the counter-injector side, a horizontal surface 14*e* is formed. Moreover, the counter-injector side sloped surface 14*d* of the piston crown surface 14*a* is formed with exhaust valve recesses 14*f* which are concaved to avoid contact between the piston 14 and the exhaust valves 24, respectively. Note that contact between the piston 14 and the intake valves 22 is avoided by the injector side sloped surface 14*c*, etc.

Figure 3:
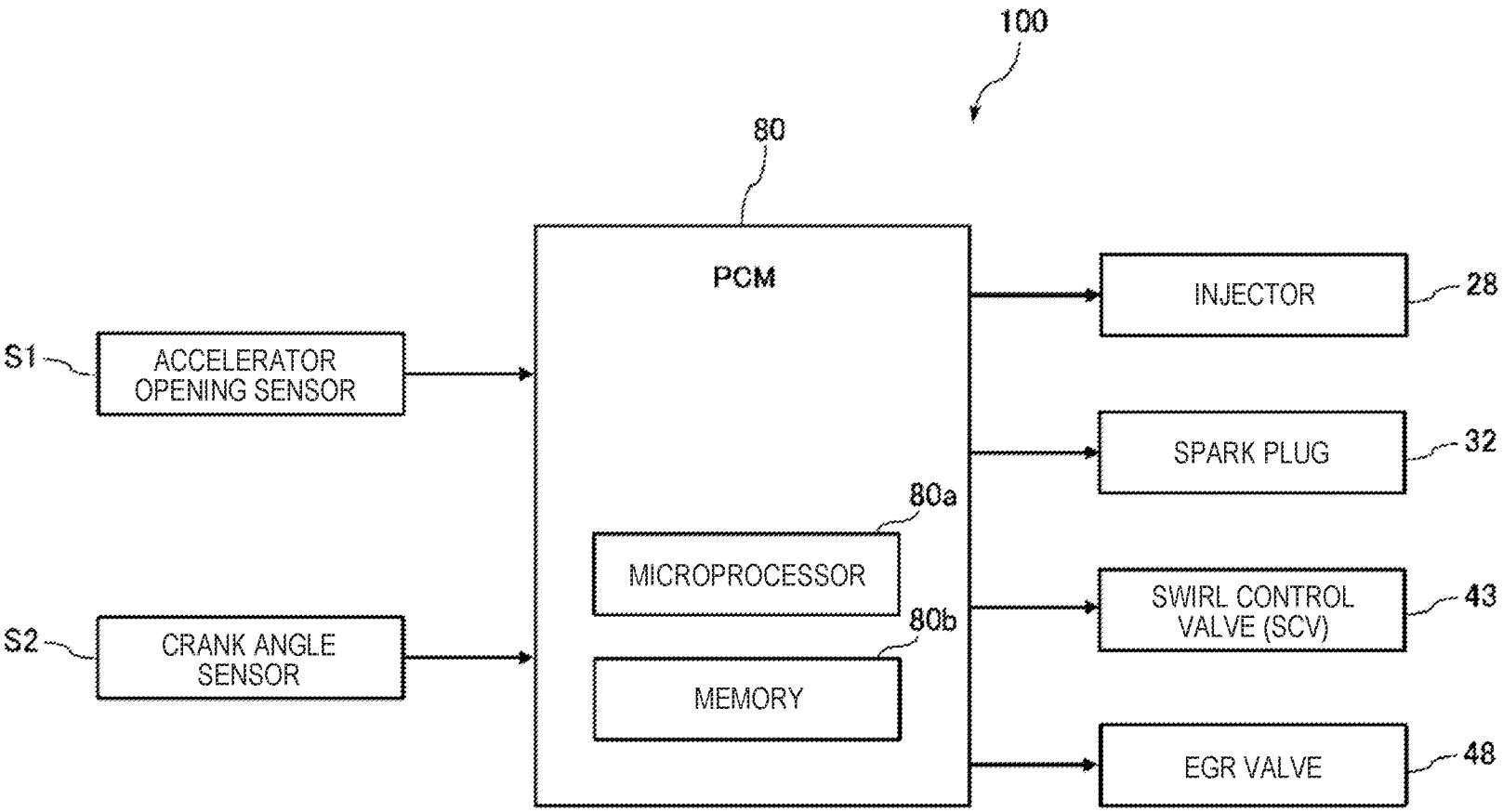
FIG. 3 is a block diagram illustrating an electrical configuration of the engine system according to this embodiment.

Next, FIG. 3 is a block diagram illustrating an electrical configuration of the engine system 100 according to this embodiment. PCM (Powertrain Control Module) 80 is comprised of a circuit, and is a controller based on a well-known microcomputer. The PCM 80 is provided with, for example, one or more microprocessor 80*a* (e.g., a CPU (Central Processing Unit)) which executes a program, memory 80*b* which is comprised of RAM (Random Access Memory) and/or ROM (Read Only Memory) and stores the program and data, and an I/O bus which inputs and outputs electric signals.

The PCM 80 is connected to various sensors. For example, the PCM 80 is mainly connected with an accelerator opening sensor S1 and a crank angle sensor S2. The accelerator opening sensor S1 detects an accelerator opening corresponding to a depressing amount of an accelerator pedal, and the crank angle sensor S2 detects a rotational angle of the crankshaft 12 (corresponding to an engine speed). Detection signals outputted from these sensors S1 and S2 are inputted into the PCM 80.

The PCM 80 calculates, based on the detection signals inputted from the sensors S1 and S2, a control amount of each device in accordance with a control logic defined in advance. The control logic is stored in the memory 80*b*. The control logic includes calculating a target amount and/or the control amount by using a map stored in the memory 80*b*. The PCM 80 outputs control signals related to the calculated control amounts mainly to the injector 28, the spark plug 32, the SCV 43, and the EGR valve 48.

Control Contents

Next, control contents executed by the PCM 80 according to this embodiment are described. Basically, the PCM 80 switches the opening and closing of the SCV 43 corresponding to a change in an operation state of the engine 1, that is, switches the SCV 43 from fully closed to fully opened, or from fully opened to fully closed. According to this, whether to introduce the swirl flow into the combustion chamber 16 by the SCV 43 is switched according to the operation state of the engine 1.

Figure 4:
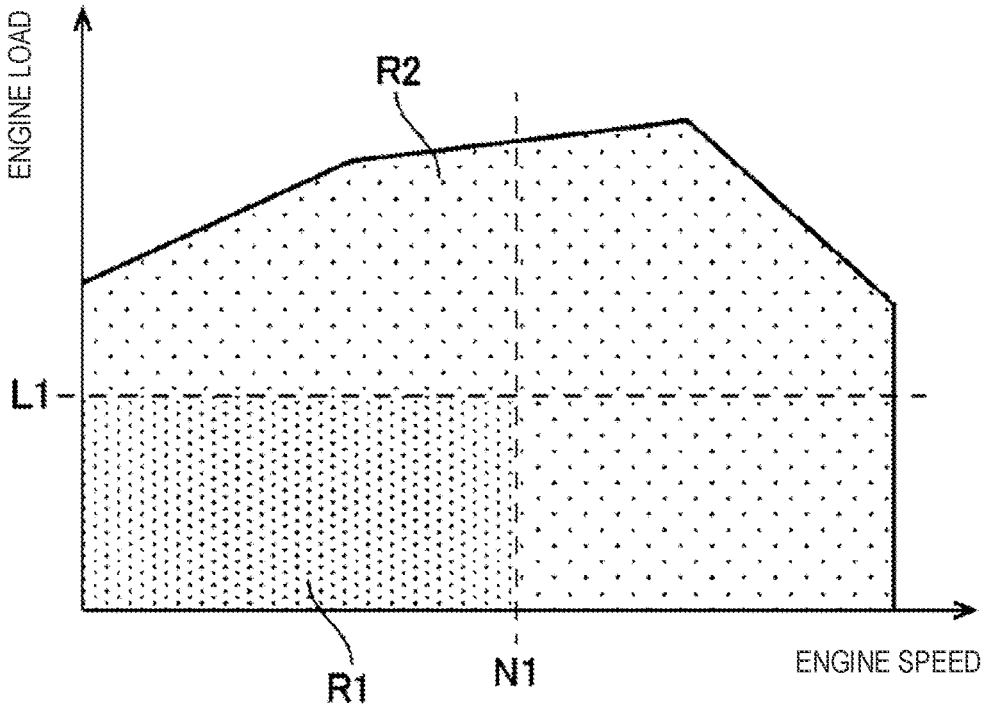
FIG. 4 illustrates operation ranges of the engine according to this embodiment.

First, with reference to FIG. 4, the operation ranges of the engine 1 in which the SCV 43 is set to fully closed or fully opened are described. FIG. 4 illustrates the operation ranges of the engine 1 defined by the engine speed indicated by the horizontal axis and the engine load indicated by the vertical axis. In an operation range R1 where the engine speed is at or below a speed threshold N1 (e.g., 2,500 rpm) and the engine load is at or below a load threshold L1, the SCV 43 is set to fully closed, that is, the engine 1 is operated using the swirl flow generated by closing the SCV 43. In addition, in the operation range R1, the injector 28 injects fuel all at once (batch injection) during an intake stroke of the engine 1 in the state where the swirl flow is generated, and thus homogeneous combustion being achieved in the engine 1.

On the other hand, in an operation range R2 where the engine speed exceeds the speed threshold N1 or the engine load exceeds the load threshold L1, the SCV 43 is set to fully opened, that is, the engine 1 is operated without using the swirl flow. Further, when the engine speed is at or below the speed threshold N1 in the operation range R2, the injector 28 dividedly injects fuel a plurality of times (split injection) during an intake stroke and a compression stroke of the engine 1, and thus stratified-charge combustion is achieved in the engine 1. In contrast, in a range where the engine speed exceeds the speed threshold N1 in the operation range R2, the injector 28 injects fuel all at once (batch injection) during an intake stroke of the engine 1, and thus homogeneous combustion is achieved in the engine 1.

Note that FIG. 4 illustrates an example in which the speed threshold N1 and the load threshold L1 are fixed values, respectively. However, in other examples, the speed threshold N1 may be lowered as the engine load increases, or the load threshold L1 may be lowered as the engine speed increases. Moreover, below, the operation range R1 may suitably be referred to as a "low-load range R1," and the operation range R2 may suitably be referred to as a "high-load range R2."

As described above, in the low-load range R1, the PCM 80 controls the SCV 43 to fully close so that a swirl flow is generated inside the combustion chamber 16. Moreover, from the viewpoint of reducing a pumping loss of the engine 1, in the low-load range R1, the PCM 80 basically controls the EGR valve 48 to increase the amount of EGR gas to be recirculated to the intake passage 40 from the EGR passage 46.

Here, when the SCV 43 is switched from fully closed to fully opened corresponding to the shift of the operation state of the engine 1 from the low-load range R1 to the high-load range R2, a state where only one intake port 18 communicates with each cylinder 2 is shifted to a state where two intake ports 18 communicate with the cylinder 2. Therefore, while the SCV 43 is switched from fully closed to fully opened, a blown back amount (backflow amount) of exhaust gas to the intake passage 40 during a valve overlap period where both of the intake valve 22 and the exhaust valve 24 open increases compared with before the switching (the fully closed state of the SCV 43). According to this, during an intake stroke of the engine 1, an amount of exhaust gas (internal EGR gas) introduced into the combustion chamber 16 together with fresh air increases. As a result, when a comparatively large amount of EGR gas (external EGR gas) is recirculated from the EGR passage 46 in the low-load range R1 as described above, the total amount of exhaust gas (i.e., the total amount of external EGR gas and internal EGR gas) introduced into the combustion chamber 16 upon the switching of the SCV 43 from fully closed to fully opened becomes excessive, which degrades combustion stability.

In this embodiment, the PCM 80 executes control to suppress the degradation in combustion stability due to the excessive EGR gas when the SCV 43 is switched from the fully closed to fully opened. In detail, while the operation range is the low-load range R1 where the engine load is at or below the load threshold L1, the PCM 80 controls the EGR valve 48 such that, at a fixed speed, an increase rate of the EGR gas amount with respect to the increase in the engine load is lower in a first load range than in a second load range. The first load range is higher than the second load range, and includes the load threshold L1. That is, in the low-load range R1, when the engine load is separated from the load threshold L1, the PCM 80 controls the EGR valve 48 to increase the amount of EGR gas as the engine load increases. On the other hand, when the engine load is near the load threshold L1, the PCM 80 controls the EGR valve 48 to avoid the increase in the amount of EGR gas corresponding to the increase in the engine load (typically, maintain the EGR gas amount substantially constant regardless of the increase in the engine load).

Figure 5:
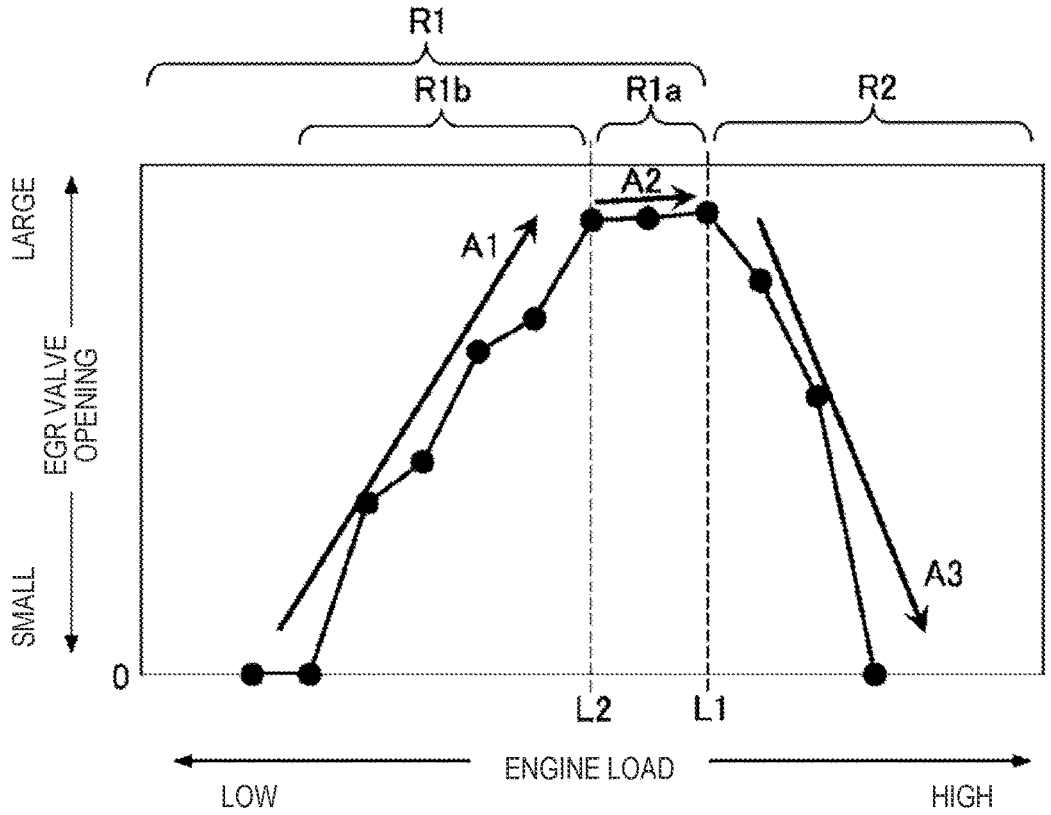
FIG. 5 is a map illustrating a relationship between an engine load and opening of an EGR valve according to this embodiment.

Here, a basic concept of the control according to this embodiment is described with reference to FIG. 5. FIG. 5 illustrates a map of an EGR valve opening (vertical axis) applied according to the engine load (horizontal axis) at a certain engine speed (e.g., 1,500 rpm). As illustrated in FIG. 5, in this embodiment, in a range on the lower load side within the low-load range R1 (in detail, in a second load range R1*b* at or below a given load L2 in the low-load range R1), the PCM 80 gradually increases the EGR valve opening so as to increase the EGR gas amount corresponding to the increase in the engine load (see an arrow A1), in view of reducing the pumping loss of the engine 1.

Particularly, in this embodiment, in a range on the higher load side within the low-load range R1 (in detail, in a first load range R1*a* between the given load L2 and the load threshold L1 (i.e., higher than the given load L2 and lower than the load threshold L1)), the PCM 80 reduces the increase rate of the EGR valve opening with respect to the increase in the engine load (see an arrow A2), compared with in the second load range R1*b*. In more detail, in the first load range R1*a*, the PCM 80 keeps the EGR valve opening substantially constant regardless of the engine load increase. According to this, even when the amount of internal EGR gas increases during the switching of the SCV 43 from fully closed to fully opened corresponding to the shift of the operation state of the engine 1 from the low-load range R1 to the high-load range R2, the increase in the amount of external EGR gas corresponding to the increase in the engine load can accurately be suppressed. As a result, upon the switching of the SCV 43 from fully closed to fully opened, the increase in the total amount of exhaust gas (i.e., the total amount of external EGR gas and internal EGR gas) introduced into the combustion chamber 16 can be suppressed, and combustion stability can be secured.

Note that in a range on a further lower load side within the second load range R1*b*, in order to give priority to securing combustion stability, the EGR valve opening is set to zero so as not to introduce EGR gas into the combustion chamber 16. On the other hand, in the high-load range R2, in view of improving an engine output by increasing an amount of fresh air, the PCM 80 gradually reduces the EGR valve opening so as to lower the EGR gas amount as the engine load increases (see an arrow A3).

Figure 6:
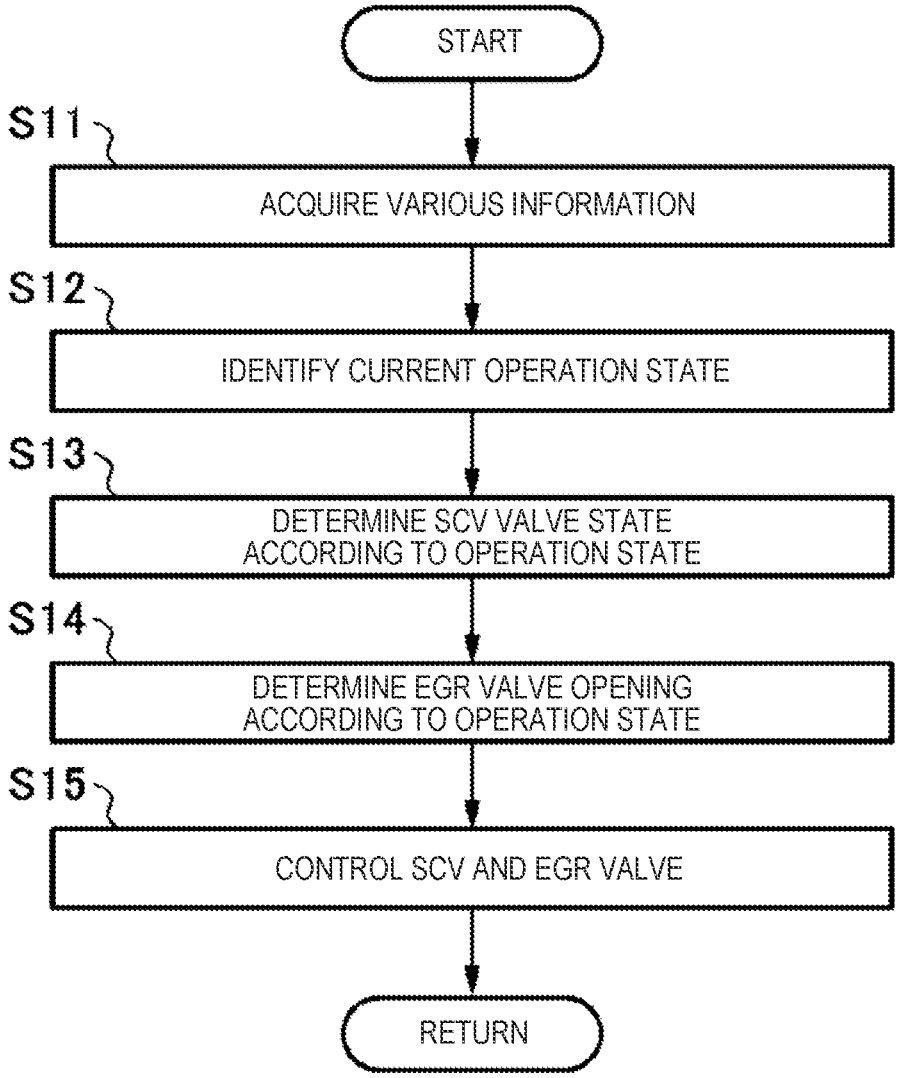
FIG. 6 is a flowchart illustrating control according to this embodiment.

Next, a control flow related to this embodiment is described with reference to FIG. 6. FIG. 6 is a flowchart illustrating the control according to this embodiment. This control is repeatedly executed by the PCM 80 at a given cycle. First, at Step S11, the PCM 80 acquires various information. For example, the PCM 80 at least acquires the detection signals of the accelerator opening sensor S1 and the crank angle sensor S2 described above.

Next, at Step S12, the PCM 80 identifies, based on the information acquired at Step S11, the current operation state of the engine 1 (in detail, the current engine speed and the current engine load). Here, the PCM 80 acquires the engine speed based on the crank angle (the rotational angle of the crankshaft 12) corresponding to the detection signal of the crank angle sensor S2. Moreover, the PCM 80 acquires a target torque of the vehicle based on the accelerator opening corresponding to the detection signal of the accelerator opening sensor S1, and then, calculates the engine load corresponding to the target torque.

Next, at Step S13, the PCM 80 determines a valve state (fully closed or fully opened) to be set for the SCV 43 based on the operation state of the engine 1 identified at Step S12. For example, when the engine speed and the engine load belong to the low-load range R1, the PCM 80 determines the valve state as fully closed, and, when the engine speed and the engine load belong to the high-load range R2, the PCM 80 determines the valve state as fully opened.

Next, at Step S14, the PCM 80 determines the EGR valve opening to be set for the EGR valve 48 based on the operation state of the engine 1 identified at Step S12. For example, the PCM 80 determines the EGR valve opening to be applied at the current engine load with reference to the map as illustrated in FIG. 5. Note that since the map illustrated in FIG. 5 is defined for each engine speed, the map corresponding to the current engine speed is selected. Then, the PCM 80 proceeds to Step S15.

Next, at Step S15, the PCM 80 controls the SCV 43 and the EGR valve 48 based on the valve state of the SCV 43 determined at Step S13, and the EGR valve opening determined at Step S14. In this case, the PCM 80 controls the EGR valve 48 to be the determined valve opening. Moreover, when the valve state of the SCV 43 determined at Step S13 is different from the current valve state, the PCM 80 switches the valve state of the SCV 43, that is, switches the SCV 43 from fully closed to fully opened, or from fully opened to fully closed. On the other hand, when the valve state of the SCV 43 determined at Step S13 is the same as the current valve state, the PCM 80 maintains the valve state of the SCV 43. Then, the PCM 80 ends the flow illustrated in FIG. 6.

Operation and Effects

Next, operation and effects of the engine system 100 according to this embodiment are described.

In this embodiment, in the low-load range R1 where the engine load is at or below the load threshold L1 at which the SCV 43 is switched from fully closed to fully opened, the PCM 80 controls the EGR valve 48 such that, at the fixed speed, the increase rate of the EGR gas amount with respect to the increase in the engine load is lower in the first load range R1*a* than in the second load range R1*b*. The first load range R1*a* is higher than the second load range R1*b*, and includes the load threshold L1. According to this, even when the internal EGR gas amount increases during the switching of the SCV 43 from fully closed to fully opened corresponding to the shift of the operation state of the engine 1 from the low-load range R1 to the high-load range R2, the increase in the external EGR gas amount corresponding to the engine load increase can accurately be suppressed. As a result, upon the switching of the SCV 43 from fully closed to fully opened, the increase in the total amount of exhaust gas (i.e., the total amount of external EGR gas and internal EGR gas) introduced into the combustion chamber 16 can be suppressed, and combustion stability can be secured.

Further, according to this embodiment, in the first load range R1*a*, the PCM 80 controls the EGR valve 48 such that the amount of EGR gas becomes substantially constant regardless of the increase in the engine load. According to this, the amount of external EGR gas introduced into the combustion chamber 16 when the SCV 43 is switched from fully closed to fully opened can effectively be reduced, and the combustion stability can certainly be secured.

Further, according to this embodiment, in the high-load range R2, since the PCM 80 controls the EGR valve 48 to reduce the amount of EGR gas as the engine load increases, the amount of fresh air introduced into the combustion chamber 16 is increased and the engine output can be improved.

Further, according to this embodiment, in the low-load range R1, the PCM 80 executes the batch injection of fuel during an intake stroke, thereby the homogeneous combustion appropriately being achieved in the engine 1. Moreover, in the high-load range R2 (at or below the speed threshold N1), the PCM 80 executes the split injection of fuel from an intake stroke to a compression stroke, thereby the stratified-charge combustion appropriately being achieved in the engine 1.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine
2 Cylinder
14 Piston
14*a* Piston Crown Surface
16 Combustion Chamber
18 Intake Port
28 Injector (Fuel Injection Valve)
32 Spark Plug
40 Intake Passage
43 Swirl Control Valve (SCV)
44 Exhaust Passage
45 Catalyst
46 EGR Passage
48 EGR Valve (EGR Gas Adjusting Mechanism)
80 PCM (Controller)
100 Engine System

What is claimed is:

1. An engine system, comprising:

an engine including:

a cylinder defining a combustion chamber;

a piston configured to reciprocate inside the cylinder; and a fuel injection valve configured to directly inject fuel into the cylinder;

a swirl control valve provided inside an intake passage and configured to generate a swirl flow inside the cylinder when the swirl control valve closes, the intake passage being configured to supply intake air to the cylinder;

an exhaust gas recirculation (EGR) passage configured to recirculate exhaust gas of the engine as EGR gas to the intake passage;

an EGR gas adjusting mechanism provided to the EGR passage and configured to control an amount of EGR gas to be recirculated to the intake passage; and a controller configured to control the fuel injection valve, the swirl control valve, and the EGR gas adjusting mechanism, wherein when an engine load is at or below a given threshold, the controller controls the swirl control valve to close, and wherein while the engine load is at or below the threshold, the controller controls the EGR gas adjusting mechanism such that, at a fixed engine speed, an increase rate of the amount of EGR gas with respect to an increase in the engine load is lower in a first load range than in a second load range, the first load range being higher than the second load range and including the threshold.

2. The engine system of claim 1, wherein in the second load range, the controller controls the EGR gas adjusting mechanism to increase the amount of EGR gas as the engine load increases, and in the first load range, the controller controls the EGR gas adjusting mechanism to keep the amount of EGR gas substantially constant regardless of the increase in the engine load.

3. The engine system of claim 2, wherein when the engine load exceeds the threshold, the controller controls the swirl control valve to open and controls the EGR gas adjusting mechanism to reduce the amount of EGR gas as the engine load increases.

4. The engine system of claim 3, wherein when the engine load is at or below the threshold, the controller controls the fuel injection valve to inject fuel all at once during an intake stroke of the engine, and when the engine load exceeds the threshold, the controller controls the fuel injection valve to inject fuel a plurality of times from an intake stroke to a compression stroke of the engine.

5. The engine system of claim 4, wherein the fuel injection valve is provided incliningly with respect to an axial direction of the piston.

6. The engine system of claim 5, wherein a crown surface of the piston is formed to be substantially flat without a cavity.

7. The engine system of claim 1, wherein when the engine load exceeds the threshold, the controller controls the swirl control valve to open and controls the EGR gas adjusting mechanism to reduce the amount of EGR gas as the engine load increases.

8. The engine system of claim 1, wherein when the engine load is at or below the threshold, the controller controls the fuel injection valve to inject fuel all at once during an intake stroke of the engine, and when the engine load exceeds the threshold, the controller controls the fuel injection valve to inject fuel a plurality of times from an intake stroke to a compression stroke of the engine.

9. The engine system of claim 1, wherein the fuel injection valve is provided inclininglyy with respect to an axial direction of the piston.

10. The engine system of claim 1, wherein a crown surface of the piston is formed to be substantially flat without a cavity.

11. The engine system of claim 2, wherein when the engine load is at or below the threshold, the controller controls the fuel injection valve to inject fuel all at once during an intake stroke of the engine, and when the engine load exceeds the threshold, the controller controls the fuel injection valve to inject fuel a plurality of times from an intake stroke to a compression stroke of the engine.

12. The engine system of claim 2, wherein the fuel injection valve is provided inclininglyy with respect to an axial direction of the piston.

13. The engine system of claim 2, wherein a crown surface of the piston is formed to be substantially flat without a cavity.

14. The engine system of claim 3, wherein the fuel injection valve is provided inclininglyy with respect to an axial direction of the piston.

15. The engine system of claim 3, wherein a crown surface of the piston is formed to be substantially flat without a cavity.

16. The engine system of claim 4, wherein a crown surface of the piston is formed to be substantially flat without a cavity.

17. The engine system of claim 1, wherein the EGR gas adjusting mechanism is an EGR valve.

18. The engine system of claim 2, wherein the EGR gas adjusting mechanism is an EGR valve.

19. The engine system of claim 6, wherein the EGR gas adjusting mechanism is an EGR valve.

* * * * *